United States Patent [19]

Dickinson, III et al.

[11] Patent Number: 4,497,381

[45] Date of Patent: Feb. 5, 1985

[54] EARTH DRILLING APPARATUS AND METHOD

[75] Inventors: Ben W. O. Dickinson, III, San Francisco; Robert W. Dickinson, San Rafael; Irving L. Odgers, Loomis; James McGhee, Berkeley, all of Calif.

[73] Assignee: Bechtel National, Inc., San Francisco, Calif.

[21] Appl. No.: 471,431

[22] Filed: Mar. 2, 1983

[51] Int. Cl.[3] ..... E21B 7/08; E21B 7/18

[52] U.S. Cl. ..... 175/61; 72/166; 72/388; 175/77

[58] Field of Search ..... 166/297, 55; 299/17; 175/61, 77, 78; 72/166, 169, 133, 149, 388, 387

[56] References Cited

U.S. PATENT DOCUMENTS 1,865,853 7/1932 Granville ..... 175/45 X
4,003,233 1/1977 Strange ..... 72/133

FOREIGN PATENT DOCUMENTS 747985 7/1980 U.S.S.R. ..... 175/77

*Primary Examiner*—Stephen J. Novosad
*Assistant Examiner*—Michael Starinsky
*Attorney, Agent, or Firm*—Flehr, Hohbach, Test, Albritton & Herbert

[57] ABSTRACT

Earth well drilling apparatus including piping in a well, a metal drilling tube within the piping, and a hydraulic jet drilling head secured to the lower end of the tube. A seal is disposed between the piping and the tube. The drilling head is urged downwardly through the piping under hydraulic pressure through a tube bneding assembly laterally extensible from a retracted position substantially within the structure. The hydraulic pressure propels the tube downwardly through the piping and bending assembly to bend the tube and to direct the drilling head laterally toward the formation.

13 Claims, 5 Drawing Figures

EARTH DRILLING APPARATUS AND METHOD

This invention relates generally to earth well drilling apparatus and methods. Particularly it relates to apparatus and methods applicable to drilling one or more bores extending laterally from a lower region of a well into a mineral bearing formation.

Reference is made to co-pending application Ser. No., 401,613 filed July 26, 1982, entitled Hydraulic Piston-Effect Method and Apparatus for Forming a Bore Hole, and the continuation-in-part of that application Ser. No. 471,437 filed simultaneously herewith, and co-pending application likewise filed simultaneously herewith entitled EARTH DRILLING APPARATUS AND METHOD, in the names of Sherman May, Charles Mackey, Robert Wayne Dickinson and Wade Dickinson, Ser. No. 471,430.

It has been recognized that minerals may be recovered from mineral-bearing formations by introducing such agents as steam, hot water, chemical solutions and the like. For example steam has been introduced into petroleum-bearing sands (e.g. tar sands or heavy oil) and other porous formations to effect the release and removal of petroleum not otherwise having sufficient fluidity to permit pumping from the well. Certain of such equipment and methods employ special drilling apparatus for drilling a laterally extending bore from a region of the well at the level of the formation, after which steam or other treating fluid is introduced into the bore. An example of such drilling apparatus is disclosed in U.S. Pat. No. 2,258,001, Oct. 7, 1941 and U.S. Pat. No. 1,865,853, July 5, 1932. Such prior drilling equipment and methods have been subject to certain disadvantages. In instances where drilling the lateral bore has employed a rotated cutting head which is directed laterally against the formation, the torque may be applied to the head through driving means extending from the top of the well, which requires complicated and expensive means to transmit power through a vertically rotated pipe or shaft to the laterally directed drillhead. If an electrical driving motor is employed, it must be located within the well and coupled to the drillhead, which poses problems in applying the electrical energy and requires removal of the motor and drilling head before injecting steam or other treatment fluid. Use of laterally directed jet drilling as shown in U.S. Pat. No. 2,258,001 requires special flexible piping which carries the drillhead and to which hydraulic liquid under pressure is applied. Among other objections, flexible conduits are not self-supporting when projected laterally and thus require additional supporting means such as a surrounding housing as shown in U.S. Pat. No. 2,258,001.

Co-pending application Ser. No. 401,613, filed July 26, 1982, and said continuation-in-part application discloses an apparatus and method making use of hydraulic jet drilling with the drillhead being attached to a drilling tube of the solid wall type. The drilling tube initially is carried within piping extending downwardly into the well, and has an open upper end. A seal is provided between the drilling tube and the piping, whereby when hydraulic liquid (e.g. water) under pressure is applied to the piping, the drilling tube is propelled downwardly. A special form of tube bending means is carried at the lower end of the piping adjacent the mineral bearing formation, and forms an arcuate guideway through which the drilling tube is propelled, thereby causing the drilling tube to be bent and the drilling head projected laterally into the formation.

It is an object of the present invention to provide an improved embodiment of the apparatus and method disclosed in the aforesaid application, Ser. No. 401,613.

Another object is to provide an embodiment of bending means for such apparatus and methods which can be extended from a retracted to an extended position to form a tube bending guideway.

Another object of the invention is to provide means for straightening the drilling tube as it exits from the guideway.

In general the present invention consists of a structure adapted to be positioned within a well adjacent a mineral producing region, and which is carried by piping extending to the surface of the well. A drilling tube of the solid wall type is disposed within the piping, and a tube having a hydraulic jet type of drilling head secured to its lower end. The upper end of the drilling tube is open within the piping, and a seal is provided between the tube and the piping. Tube bending means is carried by the structure and includes two connected assemblies which when extended from a retracted position within the structure, form an arcuate tube bending guideway. When hydraulic pressure is applied to the piping it applies force to the drilling tube to propel it downwardly through the piping and through the guideway, thereby causing the tube to be bent to project the drilling head laterally toward the formation for cutting of the bore hole. The bending means also carries means for straightening the tubing as it exits from the guideway. The invention includes both novel apparatus, and a novel method making use of such apparatus.

Additional objects and features of the invention will appear from the following description in which preferred embodiments have been set forth in detail in conjunction with the accompanying drawing.

REFERRING TO THE DRAWING

Figure 1:
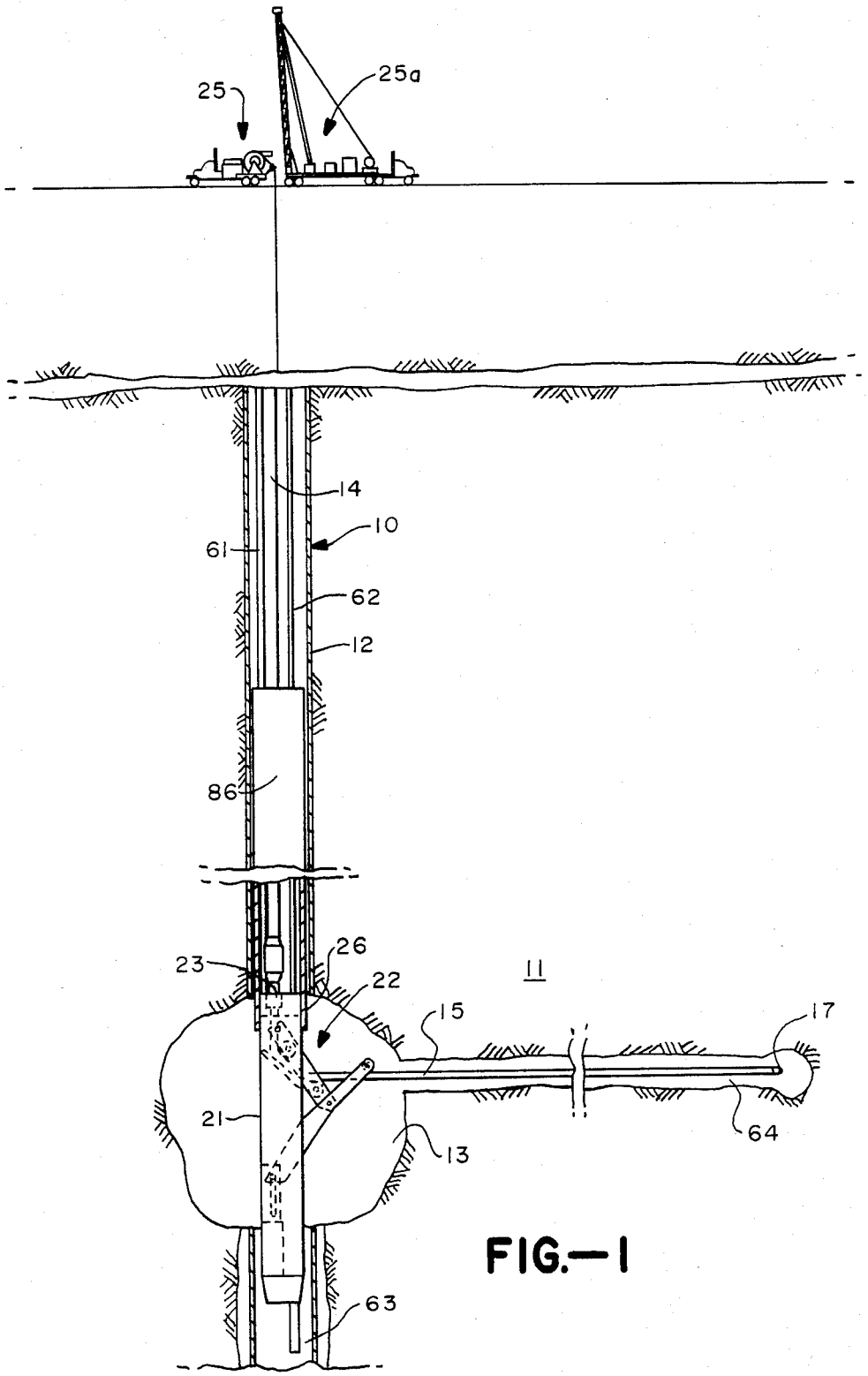
FIG. 1 is a schematic view in side elevation, illustrating the apparatus disposed within an earth well, with the drilling tube extended in a lateral bore.
Figures 4, 5:
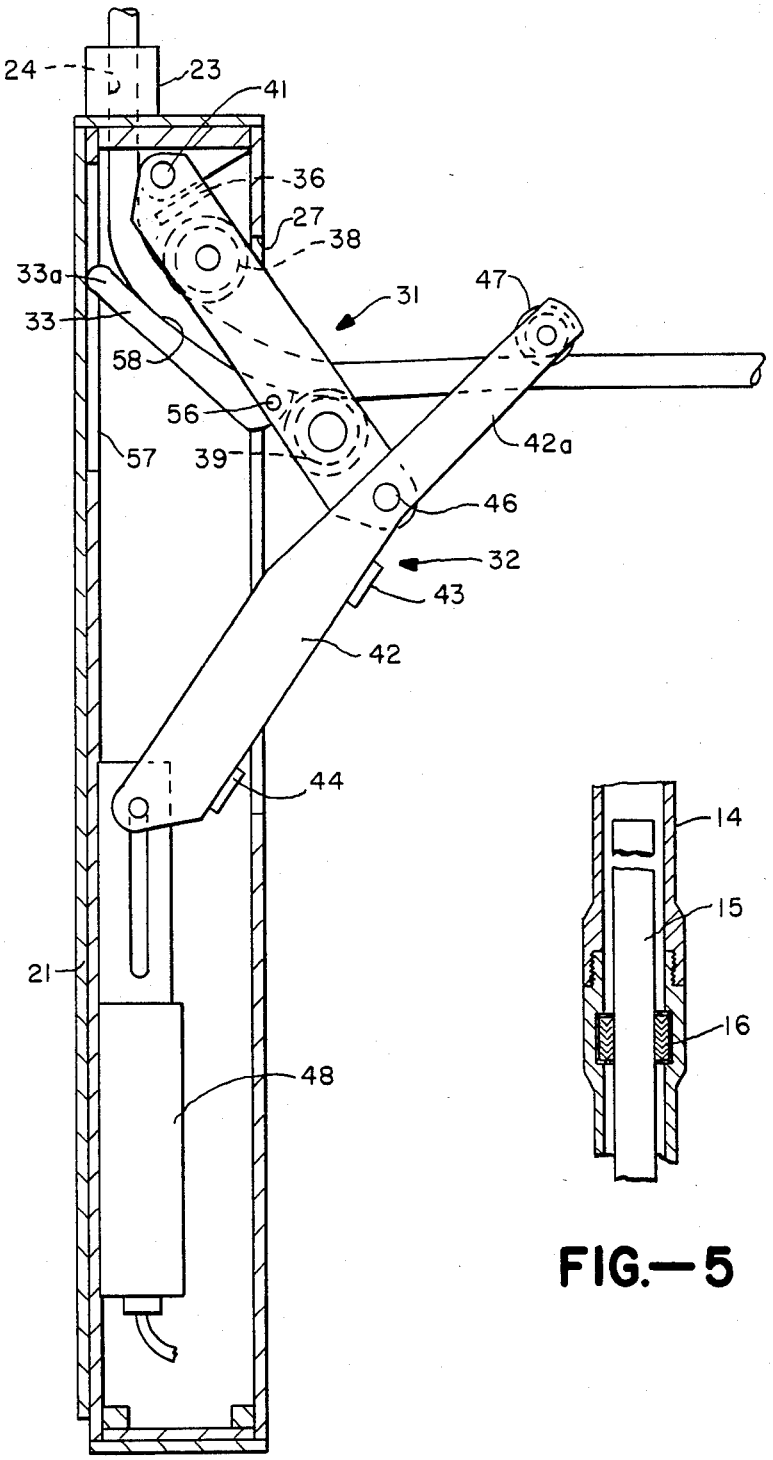
FIG. 4 is a detail in section elevation, illustrating the bending means in side elevation and extended.
FIG. 5 is a detail of the drilling tube and seal assembly within the guide piping.

FIG. 1 schematically shows an earth well 10 which extends down to the mineral bearing formation 11. In this instance the well is shown provided with a casing 12, which may extend down to a cavity 13 that is within the formation 11. The piping extending into the well consists in this instance of a guide tube or pipe string 14 within which a drilling tube 15 is disposed. As shown in FIG. 5, a seal 16 is mounted within the pipe string 14, and forms a seal between the pipe string and the drilling tube 15. The upper open end of the drilling tube 15 is above the seal 16, when the drilling tube is fully extended as shown in FIG. 1. Before the drilling tube is extended it is within the pipe string 14, with its drilling head 17 located below the seal 16. The structure 21 serves to carry the tube bending means 22.

FIG. 1 also schematically shows a production rig 25*a* of the mobile type, and a reel carrying truck 25 which may carry a supply of the drilling tubing 15.

Figure 2:
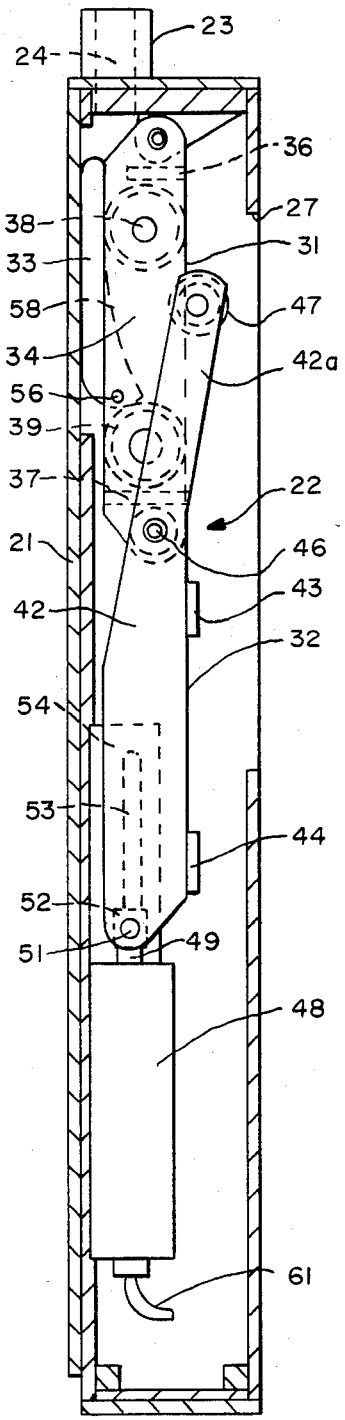
FIG. 2 is a detail in side elevation, illustrating the retracted tube bending means and its mounting.
Figure 3:
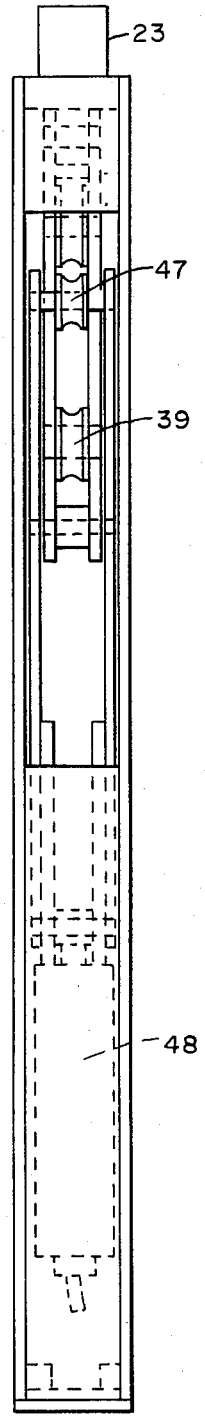
FIG. 3 is a detail looking toward the right hand side of FIG. 2.

The structure 21 as illustrated in FIG. 2 is box-like in configuration, with a member 23 at its upper end having a passage 24 through the same which corresponds to the inner diameter of the pipe string 14. Also it is desirable for the upper portion of the structure 21 to be attached to the lower end of the pipe section 26, which extends upwardly into the lower portion of the well casing 12 and serves to reinforce the structure 21 against side thrust. One side of the structure 21 is provided with the opening 27 through which the bending means 22 is adapted to extend from its retracted position. The bending means in this instance consists of two assemblies 31 and 32, together with the member 33.

Assembly 31 consists of spaced parallel side walls or plates 34, which are rigidly connected as by members 36 and 37. The upper end of the assembly 31 has a pivotal connection 41 with the upper end of the structure 21. The assembly also includes the rotatable sheaves 38 and 39.

The assembly 32 consists of spaced parallel side members 42, which are rigidly connected by the members 43 and 44. The lower ends of the members 34 of assembly 31 have pivotal connection 46 with the members 42 of the assembly 32. The side members 42 have extensions **42*a*, which serve to carry the rotatable sheave 47**.

Power operating means is provided for extending the bending means from retracted to extended positions. The power means illustrated consists of a pneumatic or hydraulic operator 48 of the piston-cylinder type, having its operating rod 49 pivotally connected to the lower end of the members 42, as indicated at 51. Also the operating rod is shown provided with a slide 52 which is guided within the trackway 53, which is formed in the member 54, that is secured to the adjacent wall of the structure 21. The centers of the pivotal connections 41 and 51, and the connection 46 are such that the axis of connection 46 is to the right of the line of centers between the connections 41 and 51. Thus when the operator is energized to apply upward force to the assembly 32, a force component is created which urges both the assemblies 31 and 32 to the right as illustrated in FIG. 2, and to the extended position shown in FIG. 4.

The member 33 which cooperates in the tube bending operation, consists of a rigid bar, having a pivotal connection 56 with the side members 34 of assembly 31. For the collapsed condition shown in FIG. 2 the bar 33 extends upwardly between the assembly 31 and the back wall of the structure 21. As the two assemblies 31 and 32 are extended the bar 33 swings downwardly to the position shown in FIG. 4. During movement of the bar 33 to the position shown in FIG. 4, its extremity **33*a* is guided within the slot 57, formed in the adjacent backwall of the structure 21. The upper surface 58 of the bar 30** is arcuate or curved, and forms a surface over which the drilling tube passes during the initial bending process.

Operation of the system and apparatus described above, and the carrying out of the present method, are as follows. Assuming that the earthwell has been drilled down to a region where it is desired to laterally penetrate a mineral bearing formation (e.g. tar or heavy oil sands), a cavity 13 may be formed at the level of the mineral bearing formation. This can be carried out by conventional equipment. The pipe string 14 is equipped with the drilling tube 15, which is provided with a drilling head 17 of the hydraulic jet-type. The tube as it is situated within the pipe string 14 has its upper open end well above the seal 16, and its drillhead 17 below the seal but above the bending means. The lower end of the pipe string 14 is secured to the member 23 whereby the passage through the drillhead is in alignment with the passage 24. A pipe 61 extends down from the surface of the well and connects with the hydraulic operator 48, whereby hydraulic liquid under pressure can be applied to activate the operator 48. Another pipe 62 may extend down into the sump 63 and may serve as a foam downcomer or a tube for introducing cement. Hydraulic pressure is applied to the operator 48 through pipe 61, whereby the operator 48 applies upward movement to the lower end of the assembly 32, thus causing both assemblies 31 and 32 to swing outwardly through the opening 27, to the extended position shown in FIGS. 4 and 1. After the bending means has been extended in this manner, liquid (e.g. water) is applied under pressure to the upper end of the pipe string 14, the pressure being sufficient to drive the drilling tube downwardly and through the bending means. By way of example, the hydraulic pressure may range from 1,000 to 10,000 psi or more. The liquid flows into the drill tube 15 through the upper end of the same, and applies force against the fluid pressure area presented by the tube and the inner surface of the drilling head 17. This causes the drilling tube to be forced downwardly through the seal 16, and through the bending means, as shown in FIG. 4. In its movement through the bending means it engages the upper surface 58 of the bar 33, which applies initial bending forces. It is held down upon the surface 58 by the sheave 38. As the tube leaves the surface 58 of the bar 30, it moves over the sheave 39 which tends to lift the tube from the surface 58 of bar 30, and from thence continues outwardly and between the extensions **42*a* of the assembly 32. The sheave 47 engages the upper side of the tube, and applies downward forces which serve to straighten the tube. The continued application of hydraulic pressure to the pipe string 14 causes the jet drilling head 17 to be urged toward the formation 11, with the result that the hydraulic jets drill a bore 64 extending laterally from the cavity 13. The lateral extent of the bore 64 is limited by the length of the tube 15, since the upper end of this tube must not pass through the seal 16**.

After carrying out the lateral drilling operation described above, a treatment fluid, such as high temperature steam, can be introduced downwardly through the pipe string 14, and through the tube 15. Assuming that the formation consists of sand or other porous material, and that the treating fluid is high temperature steam, high viscosity petroleum is thereby made lower in viscosity and may flow through the formation to points of collection, e.g. production wells.

The bending radius applied to the drilling tube may be relatively short, as for example of the order from about 6 to 12 inches, for steel tubes ranging from about $1\frac{1}{4}$ to $1\frac{1}{2}$ inches OD, and wall thicknesses of the order of about 0.080 to 0.125 inches. The metal of the tubing may, for example, have yield points ranging from 36,000 to 70,000 lbs. or more per square inch. The ability of the apparatus to bend the tube in this manner is attributed in part to the fact that during bending the interior of the tube is under relatively high internal hydraulic pressure, which imposes hoop stresses and tends to prevent collapsing or buckling of the tube. Also under such pressures, bending occurs rapidly and appears to involve plastic flow of the metal.

What is claimed is:

1. Earth well drilling apparatus comprising a structure adapted to be positioned within a well adjacent a mineral producing region, piping in the well to which the structure is secured, a drilling tube of the solid metal wall type disposed within the piping, means for applying hydraulic liquid under pressure to the piping and tube, a drilling head of the hydraulic jet type secured to the lower end of the tube, means forming a seal between the piping and the tube, the tube and drilling head being urged downwardly through the piping when hydraulic pressure is applied to the same, tube bending means carried by the structure, said bending means being laterally extensible from a retracted position substantially within the configuration of the structure and serving when extended and when hydraulic pressure is applied to the tube to propel the same downwardly through the piping and bending means to bend the tube and to direct the tube and drilling head laterally toward the formation.

2. Apparatus as in claim 1 together with power means for extending the bending means.

3. Apparatus as in claim 1 together with the tube straightening means carried by the extensible bending means for applying force to straighten the tube as it leaves the bending means.

4. Apparatus as in claim 1 in which the extensible bending means serves to bend the tube beyond the elastic limit of its metal walls.

5. Apparatus as in claim 1 in which the extensible means when retracted consists of two upper and lower assemblies, the upper assembly having its upper end pivotally secured to the structure, and being pivotally connected to the lower assembly, and power means carried by the structure and connected to the one of said assemblies whereby when said power means is actuated, both assemblies are moved from their retracted to their extended positions.

6. Apparatus as in claim 5 in which said two assemblies when extended form a curved guideway through which the tube is propelled with bending of the same, the guideway including guide rollers or sheaves mounted on the upper part.

7. Apparatus as in claim 6 in which the guideway includes a bar extending along a portion of the guideway, the bar having an upper surface forming a part of the guideway.

8. Apparatus as in claim 7 in which one end of the bar is pivotally connected to the upper assembly and its other end slidably disposed in a trackway of said structure.

9. Apparatus as in claim 5 together with tube straightening means mounted on the lower assembly of the bending means and which functions to apply forces to the tube for straightening the same.

10. Apparatus as in claim 9 in which the tube straightening means includes a roller or sheave disposed to engage the upper side of the tube.

11. A method of forming at least one laterally extending bore from a portion of an earth well that is adjacent a mineral-bearing formation, the method making use of piping adapted to extend within the well, a drilling tube of the solid wall type within the piping, the drilling tube having a hydraulic jet-type drilling head at its lower end, and tube bending means carried by the piping, the method comprising locating the drilling tube within the piping with a seal between the tube and the piping, causing the tube bending means to be retracted, lowering the piping and tube bending means into the well together with the drilling tube, causing the tube bending means to be positioned adjacent the mineral-bearing formation, extending the tube bending means toward the formation, applying hydraulic liquid under pressure to the piping and tube to propel the tube downwardly through the piping and seal and through the tube bending means, thereby causing the drilling head to be projected laterally and urged toward and into the formation to carry out drilling of a laterally extending bore.

12. A method as in claim 11 in which the tube is subjected to straightening forces as it leaves the extensible tube bending means.

13. A method as in claim 11 in which energy is supplied from a source above the tube bending means to extend or retract the tube bending means.

* * * * *